US009569947B2

(12) United States Patent
Ordy et al.

(10) Patent No.: US 9,569,947 B2
(45) Date of Patent: Feb. 14, 2017

(54) FOREWARNING OF RISKS WHEN WORKING ON AN AIRCRAFT

(71) Applicant: Airbus Operations (SAS), Toulouse (FR)

(72) Inventors: Bernard Ordy, Blagnac (FR); Alexis Jacquemin, Maurens (FR); Sylvain Chamaillard, Toulouse (FR); Eric Jastrzebski, Plaisance du Touch (FR)

(73) Assignee: Airbus SAS, Blagnac (FR)

( * ) Notice: Subject to any disclaimer, the term of this patent is extended or adjusted under 35 U.S.C. 154(b) by 31 days.

(21) Appl. No.: 14/698,135

(22) Filed: Apr. 28, 2015

(65) Prior Publication Data

US 2015/0317888 A1 Nov. 5, 2015

(30) Foreign Application Priority Data

May 2, 2014 (FR) ..... 14 54012

(51) Int. Cl.

| | |
|---|---|
| ***G08B 23/00*** | (2006.01) |
| ***G08B 21/02*** | (2006.01) |
| ***G08B 21/22*** | (2006.01) |
| *G08B 13/14* | (2006.01) |
| *G08B 21/00* | (2006.01) |
| *G08B 17/12* | (2006.01) |

(52) U.S. Cl.
CPC ..... *G08B 21/02* (2013.01); *G08B 21/22* (2013.01); *G08B 23/00* (2013.01)

(58) Field of Classification Search
CPC ..... G08B 21/02; G08B 21/22; G08B 23/00
USPC ..... 340/573.1, 539.1
See application file for complete search history.

(56) References Cited

U.S. PATENT DOCUMENTS

| | | | | |
|---|---|---|---|---|
| 4,937,795 | A * | 6/1990 | Motegi | A41D 13/00 340/539.1 |
| 7,298,258 | B1 * | 11/2007 | Hudgens | F16P 3/14 340/3.1 |
| 2007/0001835 | A1 | 1/2007 | Ward et al. | |
| 2008/0084317 | A1 | 4/2008 | Gakhar et al. | |
| 2010/0090829 | A1 | 4/2010 | Pujol | |
| 2014/0002271 | A1 * | 1/2014 | Frederick | F16P 3/14 340/686.6 |
| 2014/0361903 | A1 * | 12/2014 | Sawada | G01V 15/00 340/686.6 |

(Continued)

FOREIGN PATENT DOCUMENTS

| | | |
|---|---|---|
| FR | 2911987 | 8/2008 |
| WO | 0223498 | 3/2002 |

(Continued)

OTHER PUBLICATIONS

French Search Report, Jan. 15, 2015.

*Primary Examiner* — Jack K Wang
(74) *Attorney, Agent, or Firm* — Greer, Burns & Crain Ltd.

(57) ABSTRACT

Automating the forewarning of risks incurred when working on an aircraft, and a forewarning system. The system comprises an identification module configured to identify a set of risky zones in the aircraft and its environment during current work on the aircraft by a set of operatives, a location module configured to locate a position of each operative during the current work, and an alert module configured to generate an alert when an operative is situated in a risky zone.

10 Claims, 4 Drawing Sheets

(56) References Cited

U.S. PATENT DOCUMENTS

2016/0090196 A1* 3/2016 Besettes ..... B64C 1/1407
244/129.5

FOREIGN PATENT DOCUMENTS

| | | |
|---|---|---|
| WO | 2004068432 | 8/2004 |
| WO | 2007051955 | 5/2007 |
| WO | 2008041143 | 4/2008 |

* cited by examiner

FOREWARNING OF RISKS WHEN WORKING ON AN AIRCRAFT

CROSS-REFERENCES TO RELATED APPLICATIONS

This application claims the benefit of the French patent application No. 1454012 filed on May 2, 2014, the entire disclosures of which are incorporated herein by way of reference.

BACKGROUND OF THE INVENTION

The present invention pertains to the field of aircraft maintenance operations. In particular, the invention relates to a method and a system for forewarning of risks incurred when working on an aircraft.

The execution of maintenance tasks comprises risks which are customarily identified in maintenance manuals by "warnings" and/or "cautions."

Indeed, during maintenance actions, certain zones on board or around the aircraft may present risks for the workers or in certain cases, risks of damage to the aircraft and/or the surrounding maintenance means. Moreover, in order to reduce the cost and duration of work on the aircraft, several maintenance and service tasks (cargo loading, refueling, pilots' check list, etc.) may be carried out in parallel thereby increasing the number of workers and the number of concurrent actions, thus introducing a risk aggravating factor.

Currently, in order to guard against risks of this kind, maintenance and service operations rely on information and protection devices implemented by technical teams applying guidelines defined by maintenance and service organizations. These devices are mainly passive forewarning tools comprising for example signaling devices (cordon tapes or panels) and/or flashing or rotary electric lights.

However, the installation of these information and protection devices requires a non-negligible time and optionally more operatives. Furthermore, these devices are addressed in a global manner at all the workers without taking account of the specifics of each.

SUMMARY OF THE INVENTION

An object of the present invention is consequently to automate the forewarning of risks incurred when working while reducing the number of actions and the duration of the work and while yet further increasing the safety of the operations on or around the aircraft.

The present invention is aimed at automating the forewarning of risks incurred when working on an aircraft and relates to a forewarning system comprising:

- an identification module configured to identify a set of risky zones in the aircraft and its environment during current work on the aircraft by a set of operatives,
- a location module configured to locate a position of each operative during the current work, and
- an alert module configured to generate an alert when an operative is situated in a risky zone.

This is an automatic safety system which makes it possible to anticipate conflicting situations between the various operatives having to work on board or around the aircraft thus reducing the risks related to the actions of the operatives, while also reducing the number of operatives and the duration of the work.

BRIEF DESCRIPTION OF THE DRAWINGS

Other particular features and advantages of the system and of the method according to the invention will emerge better on reading the description given hereinafter, by way of nonlimiting indication, with reference to the appended drawings in which.

DETAILED DESCRIPTION OF THE PREFERRED EMBODIMENTS

A principle of the invention comprises automatically identifying the risky zones during current work on the aircraft and in alerting the workers as a function of their positions with respect to said risky zones.

Figure 1:
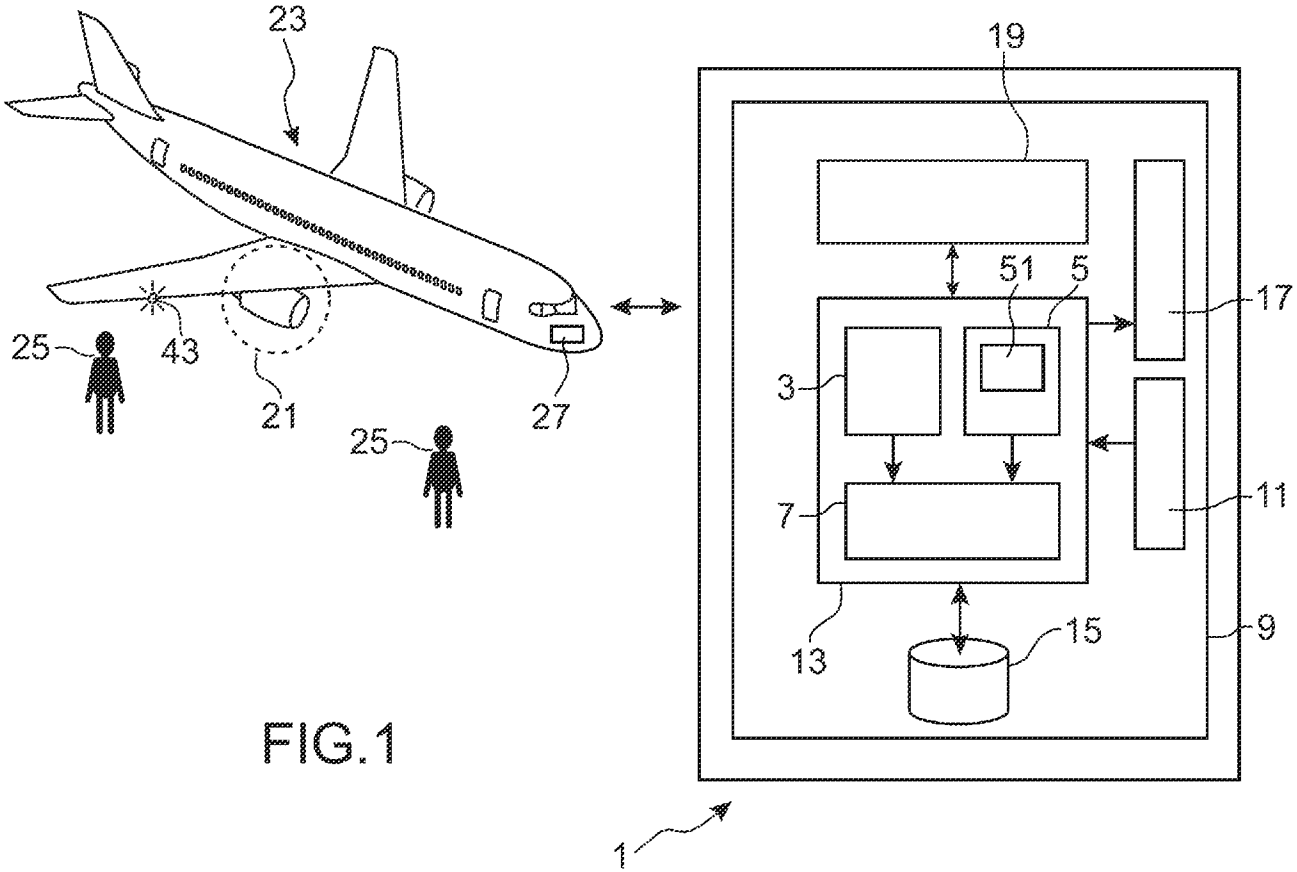
FIG. 1 illustrates in a schematic manner a system for forewarning of risks incurred when working on an aircraft, according to an embodiment of the invention.

FIG. 1 illustrates in a schematic manner a system for forewarning of risks incurred when working on an aircraft, according to an embodiment of the invention. This figure is also an illustration of a method for forewarning of risks incurred when working on an aircraft, according to an embodiment of the invention.

The forewarning system is adapted to forewarn of risks incurred when working on an aircraft to carry out maintenance and/or service operations on the latter.

In accordance with the invention, the system 1 for forewarning of risks comprises an identification module 3, a location module 5 and an alert module 7.

Advantageously, the identification module 3, location module 5 and alert module 7 are included in a mobile device 9 such as a laptop computer, a tablet, a mobile telephone, or the like. The mobile device 9 is devised to be carried by an operative, or worker, forming part of a set of operatives 25. Preferably, although not exclusively, each of the operatives of the set of operatives is equipped with a mobile device such as this. The modules 3, 5, 7 are for example implemented by one or more application(s) integrated into the mobile device 9. The latter comprises in a customary manner an input unit 11 (for example, a keyboard), a processing unit 13, a memory 15, an output unit 17 (for example, a screen), and a reception/emission unit 19 (for example, a modem). It will be noted that the memory 15 can comprise a computer program comprising code instructions suitable for the implementation of the forewarning method according to the invention.

The identification module 3 is configured to automatically identify a set of risky zones 21 in an aircraft 23 and its environment during current work on the aircraft by the set of operatives 25.

Figure 2A:
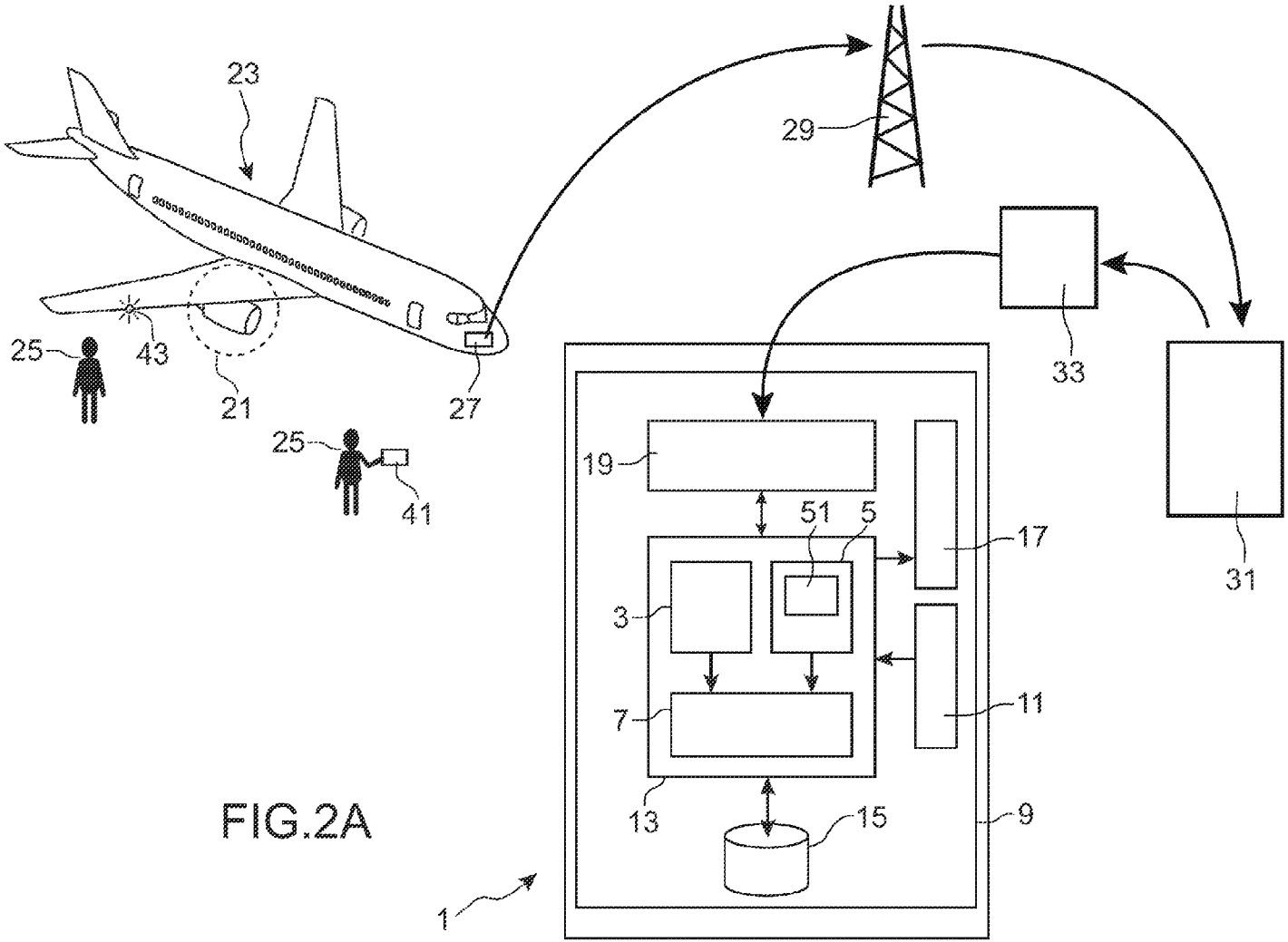
FIG. 2A illustrates in a schematic manner a forewarning system, according to a first embodiment of the invention.

FIG. 2A illustrates in a schematic manner a forewarning system, according to a first embodiment of the invention.

In general, the aircraft 23 comprises a centralized monitoring system 27 intended to record data relating to alerts, faults or anomalies detected on the aircraft during the various flights. These data can be offloaded regularly, for example after each flight and optionally, part of these data can be transmitted via communication devices to a ground station 29 which in turn transmits these data to a maintenance and service center 31.

Furthermore, the pilot of the aircraft 23 records in an electronic logbook a set of complaints based generally on alarms triggered during the flight. These complaints are also transmitted to the maintenance and service center 31.

On the basis of this set of data relating to the various alerts, faults, anomalies, and complaints, the maintenance and service center 31 compiles one or more jobcard(s) 33. A jobcard 33 comprises data relating to a scheduled set of maintenance and/or service tasks to be carried out by a set of operatives 25 during current work on the aircraft 23. With each task is associated a set of warnings to be taken into account so as to perform the actions under secure conditions.

According to this first embodiment, the identification module 3 is configured to consult at least one jobcard 33 compiled in digital format by the maintenance and service center 31. The identification module 3 is suitable for retrieving the jobcard(s) 33 from the maintenance and service center 31 by a device, for example, a telephone link.

The identification module 3 thus accesses the data relating to the scheduled set of maintenance and/or service tasks to be carried out on the aircraft 23 during the work. In particular, the identification module 3 can precisely ascertain the number of maintenance, service or crew personnel 25 as well as their actions scheduled during the current work.

Consequently, the identification module 3 according to the first embodiment is configured to extract and identify in an automatic manner the set of risky zones 21 as a function of the scheduled set of tasks to be carried out on the aircraft 23 as defined by the jobcard 33.

Figure 2B:
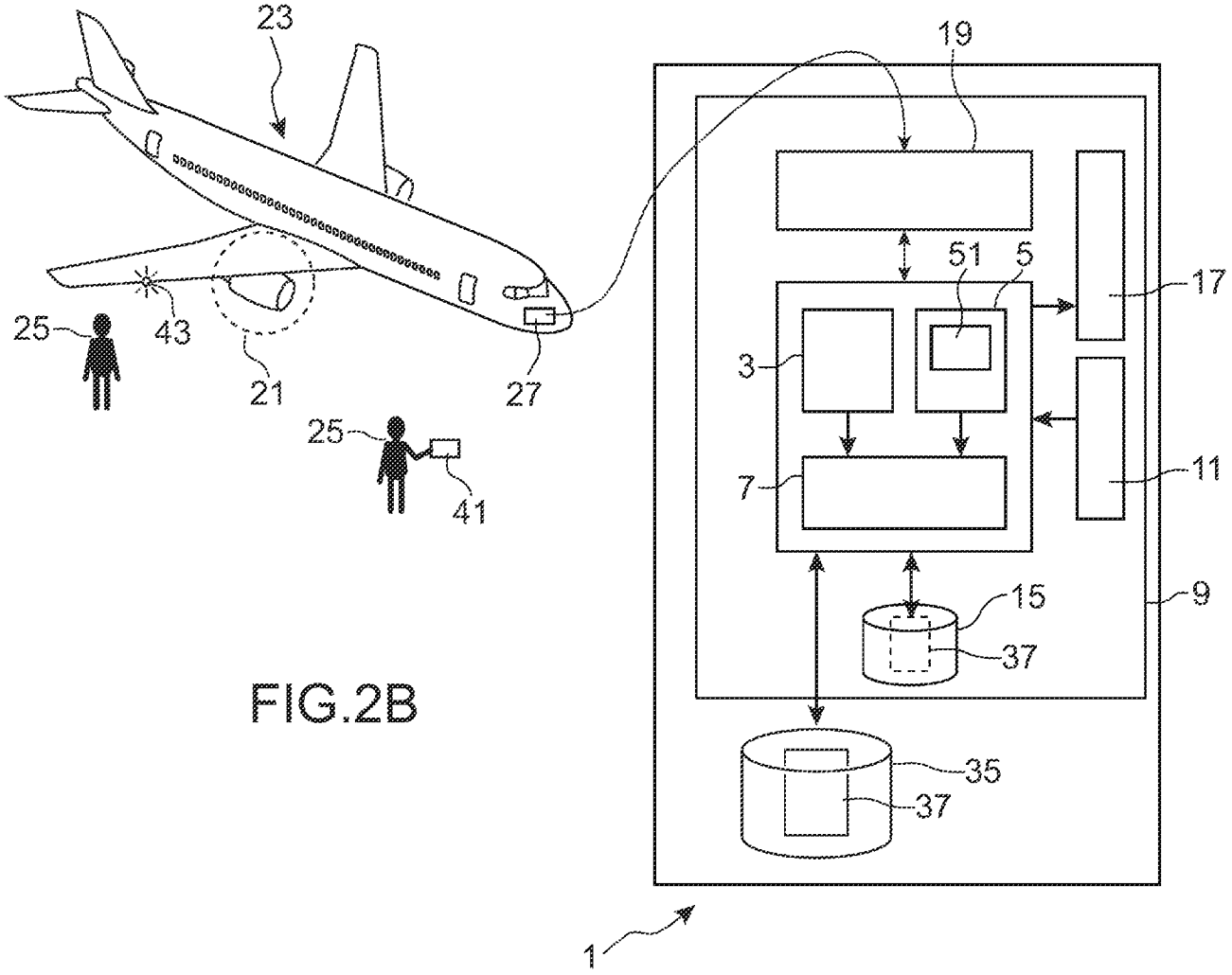
FIG. 2B illustrates in a schematic manner a forewarning system, according to a second embodiment of the invention.

FIG. 2B illustrates in a schematic manner a forewarning system, according to a second embodiment of the invention.

According to this second embodiment, the forewarning system 1 comprises a database or a storage device 35 comprising technical maintenance manuals structured for example in the form of a data dictionary 37. This data dictionary 37 is constructed on the basis of knowledge of the aircraft's technical experts, and defines a correspondence between the faults (or alerts, anomalies, etc.) detected on the aircraft 23 and the risky zones 21. Advantageously, the data dictionary 37 is stored directly in a memory 15 of the mobile device 9.

Furthermore, the identification module 3 is configured to receive from the centralized monitoring system 27 of the aircraft 23 data relating to the faults detected on the latter. Indeed, the identification module 3 is adapted for being connected in a safe manner by a wireless or optionally wired device with the centralized monitoring system 27 so as to access and to retrieve the list of faults detected on the aircraft. By using as input the information coming from the centralized monitoring system 27, the identification module 3 is thus continuously aware of the alerts and faults detected on the aircraft 23. Thus, the identification module 3 can continuously update the data relating to the faults detected on the aircraft.

The identification module 3 is also configured to interrogate the database 35 or the memory 15 so as to consult the data dictionary 37. This consultation allows the identification module 3 to identify the set of risky zones 21.

Advantageously, the identification module 3 is adapted both to consult a jobcard 33 (FIG. 2A) and the data dictionary 37 (FIG. 2A) according to the first and second embodiments.

Furthermore, the identification module 3 is configured to continuously update the identification of the risky zones 21 in the case for example where new faults are detected during the work of the operatives 25.

Moreover, in order to be able to identify the set of workers 25 called to be situated in and around the aircraft 23, the location modules 5 of the various mobile devices 9 are configured to locate in real time via communication devices the position of the operatives 25 during the current work. The location can be carried out by a location technique from among a plurality of known techniques, such as for example geo-location (of GPS or Galileo type), radio signal attenuation analysis, image recognition, infrared analysis, or radio-identification using markers of RFID radio-tag type. In the case of radio-identification, the RFID radio-tags are disposed at identified positions of the aircraft and the location module 5 comprises a geo-location device 51 configured to communicate with the RFID radio-tags. In operation, the geo-location device 51 dispatches in a repetitive manner a signal for interrogating the RFID radio-tags and it receives in return the response signals from said RFID radio-tags. As a function of the response times of the various RFID radio-tags, whose positions are known, the geo-location device 51 calculates its own position (corresponding to the position of the mobile device 9). Advantageously, a combination of two or more location techniques can also be used to further increase the precision of the positioning of the workers. The mobile device 9 is configured to transmit its position in a repetitive manner, by radiofrequency, to the other mobile devices 9 or to a central device, for example the centralized maintenance system 27, which can retransmit this position to the other mobile devices 9.

According to another embodiment of the present invention, the centralized maintenance system 27 comprises location or geo-location devices configured to communicate with for example RFID chips or markers 41 carried by the operatives 25. Thus, the various workers 25 are located with respect to the various zones of the aircraft given that the position of the aircraft 23 is already known. The centralized maintenance system 27 is configured to transmit the positions thus determined of the various operatives 25 to their various mobile devices 9.

The risky zones 21 being identified and the positions of the various operatives 25 working on or around the aircraft 23 being known, the alert module 7 of each mobile device 9 is then configured to generate an alert when an operative 25 is situated in a risky zone 21.

For example, if a maintenance task requires an activation of a door of the bay of an aircraft, the identification module 3 defines the risky zone as being the space around this bay and if a person is located in this zone by the location module 5, then an alert for example of low level is generated by the alert module 7. If in addition, the hydraulic circuit which controls the door is activated, this information being known in the jobcard of the person who has to open this door, then the level of the alarm is of a higher level.

Advantageously, the alert module 7 is configured to activate visual and/or audible devices 43 belonging to the aircraft 23 so that they emit visual and/or audible alerts of several levels (as a function of the risks), when an operative 25 or any other person approaches a risky zone 21. Accordingly, the mobile device 9 is adapted for being connected in a safe manner to a network of the aircraft, for example by radiofrequency communication, the alert module 7 being configured to activate via this network certain visual and/or audible devices 43 of the aircraft.

The alert module 7 is also configured to activate display and/or audible and/or vibratory devices carried by the operative 25. For example, sounds or radio messages are emitted by the mobile device 9 or by a headset worn by the operative 25 and optionally, vibrations are triggered in the mobile device 9 of the worker.

Figure 3:
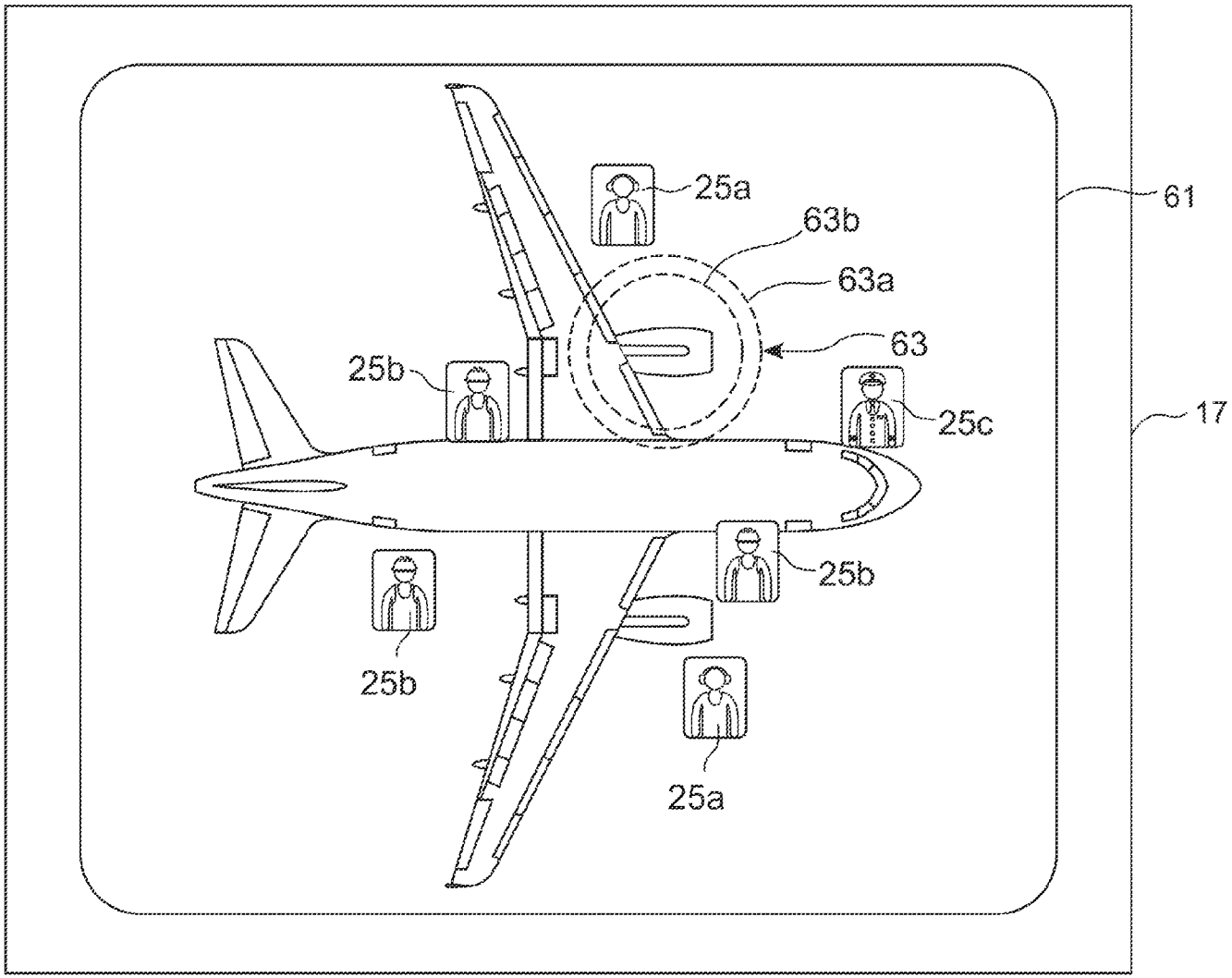
FIG. 3 illustrates in a schematic manner a map representing a set of risky zones on a screen, according to an embodiment of the invention.

Advantageously, a map representing the set of risky zones 21 is displayed on a screen 17 of the mobile device 9 of the worker as represented in FIG. 3. According to this example, the graphical representation comprises a rectangular perimeter 61 (colored yellow for example) surrounding a representation of the aircraft 23, disks 63 (colored yellow for example) representing the risky zones 21, and various icons representing the various maintenance 25*a*, service 25*b* or crew 25*c* operatives. This graphical representation can be used to verify that the actions are carried out in complete safety.

For example, if a person is in a risky zone 21, the graphical representation displays a blinking and/or a change of color of the disk 63 representing the risky zone. This visual alert can be accompanied by an audible and/or vibratory alert emitted by the mobile device 9 carried by the operative 25.

Advantageously, each risky zone 21 comprises a set of perimeters 63*a*, 63*b* defining various safety levels as a function of the distance with respect to the site liable to present a risk. In this case, the alert devices 7 are configured to generate various levels of alerts corresponding to the various safety levels. For example the various levels of alerts are achieved by emissions of sounds of various tones and/or of visual indicators of various colors.

Moreover, when the identity of the workers 25 is known by the location module 5, the alert module 7 is advantageously adapted for emitting alerts intended solely for the workers for whom these alerts are relevant. For example, it is possible to contact these people directly by GSM.

Thus, if the location module 5 detects the presence of a person in a safe zone (other than the one or ones designated to carry out a maintenance action in this zone), then the alert module 7 emits an alert (for example a voice message) to the workers 25 who are already in the process of working in this zone and optionally to the one that has just entered it.

Without departing from the scope of the invention, the alert module 7 which emits an alert intended for a worker 25 can either be the alert module 7 of the mobile device 9 carried by this worker, or an alert module of a mobile device of another worker among the workers 25. Thus, several alert modules among the alert modules of the various mobile devices 9 can emit an alert intended for one and the same worker. This makes it possible to reduce the probability of non-dispatch of an alert to this worker when the latter is situated in a risky zone.

The automatic safety method and system according to the invention thus make it possible to better protect workers by noticeably decreasing the risks related to the actions in and around the aircraft, while allowing use without risk of the parallelization of actions. They also allow easier use of remote maintenance and increased confidence of workers during risky actions. Furthermore, the reduction or elimination of physical signaling devices makes it possible to reduce the number of workers and the duration of work.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A system for forewarning of risks incurred when working on an aircraft, wherein the system comprises:

an identification module configured to identify a set of risky zones in the aircraft and its environment during current work on the aircraft by a set of operatives, a location module configured to locate a position of each operative during the current work, and an alert module configured to generate an alert when an operative is situated in a risky zone, wherein each risky zone of the aircraft is determined based on a historical data collected during at least one previous flight of the aircraft.

2. The system as claimed in claim 1, wherein said identification module is configured to consult at least one jobcard comprising data relating to a scheduled set of at least one of maintenance and service tasks to be carried out by the set of operatives on the aircraft during the current work and to identify said set of risky zones as a function of said set of tasks.

3. The system as claimed in claim 1, wherein the system comprises a storage device comprising a data dictionary defining a correspondence between faults and risky zones, and wherein the identification module is configured to receive from a centralized monitoring system of the aircraft data relating to faults detected in the aircraft and to consult said data dictionary so as to identify said set of risky zones.

4. The system as claimed in claim 1, wherein the identification module is configured to continuously update the identification of the risky zones.

5. The system as claimed in claim 1, wherein the location module comprises a location device selected from among the following devices: geo-location devices, radio signal attenuation analysis devices, image recognition devices, infrared analysis devices, or RFID chip radio-identification devices.

6. The system as claimed in claim 1, wherein said system is connected in a safe manner to a network of the aircraft and wherein the alert module is configured to activate at least one of visual and audible devices belonging to the aircraft so that they emit at least one of visual and audible alerts when an operative approaches a risky zone.

7. The system as claimed in claim 1, wherein the alert module is configured to activate at least one of display, audible and vibratory devices carried by the operative.

8. The system as claimed in claim 1, wherein each risky zone comprises a set of perimeters defining various safety levels and wherein the alert module is configured to generate various levels of alerts corresponding to the various safety levels.

9. A mobile device comprising a system for forewarning of risks incurred when working on an aircraft, wherein the system comprises:

an identification module configured to identify a set of risky zones in the aircraft and its environment during current work on the aircraft by a set of operatives, a location module configured to locate a position of each operative during the current work, and an alert module configured to generate an alert when an operative is situated in a risky zone, wherein each risky zone of the aircraft is determined based on a historical data collected during at least one previous flight of the aircraft.

10. A method for forewarning of risks incurred when working on an aircraft, comprising the following steps:

identifying a set of risky zones in the aircraft and its environment during current work on the aircraft by a set of operatives, locating a position of each operative during the current work, generating an alert when an operative is situated in a risky zone, and determining each risky zone of the aircraft based on a historical data collected during at least one previous flight of the aircraft.

* * * * *